US007465894B2

(12) United States Patent
Pearson et al.

(10) Patent No.: US 7,465,894 B2
(45) Date of Patent: Dec. 16, 2008

(54) ONE TIME HIGH FILL PRESSURE SWITCH

(75) Inventors: James E. Pearson, Downers Grove, IL (US); Russell A. Meyer, Crystal Lake, IL (US)

(73) Assignee: Robertshaw Controls Company, Richmond, VA (US)

( * ) Notice: Subject to any disclaimer, the term of this patent is extended or adjusted under 35 U.S.C. 154(b) by 0 days.

(21) Appl. No.: 11/779,693

(22) Filed: Jul. 18, 2007

(65) Prior Publication Data

US 2008/0047821 A1 Feb. 28, 2008

Related U.S. Application Data

(60) Provisional application No. 60/832,000, filed on Jul. 19, 2006.

(51) Int. Cl.
*H01H 35/36* (2006.01)

(52) U.S. Cl. ..... 200/83 R; 200/83 WM

(58) Field of Classification Search ..... 200/83 R, 200/83 WM, 83 S, 83 L, 284, 322
See application file for complete search history.

(56) References Cited

U.S. PATENT DOCUMENTS 3,249,712 A 5/1966 Rhodes et al.
3,845,265 A * 10/1974 Kothe ..... 200/83 N
4,081,637 A 3/1978 Stearley et al.
4,192,980 A * 3/1980 Kothe ..... 200/83 WM
5,187,338 A * 2/1993 Kaigler ..... 200/83 R
5,336,858 A 8/1994 Kaigler

* cited by examiner

*Primary Examiner*—Kyung Lee
(74) *Attorney, Agent, or Firm*—Reinhart Boerner Van Deuren P.C.

(57) ABSTRACT

A one time high fill pressure switch providing energy savings operation for use in a commercial or consumer appliance such as a clothes washing machine is provided. The one time high fill pressure switch provides multiple water level settings that may be selected by a user, including a maximum fill energy savings setting. Operation in the maximum fill energy savings setting allows a maximum fill level upon the first fill cycle of the programmed washing cycle. In subsequent fill cycles during the washing cycle, the one time high fill pressure switch limits the water level to a setting below the initial fill level setting. This operation is provided through the use of a hook feature on the pressure switch program cam that traps a reset spring support and is controlled by a cam follower in the pressure switch.

19 Claims, 9 Drawing Sheets

ONE TIME HIGH FILL PRESSURE SWITCH

CROSS-REFERENCE TO RELATED PATENT APPLICATION

This patent application claims the benefit of U.S. Provisional Patent Application No. 60/832,000, filed Jul. 19, 2006, the teaching and disclosure of which are hereby incorporated in its entireties by reference thereto.

FIELD OF THE INVENTION

This invention generally relates to pressure switches for appliances, and more particularly to high fill pressure switches.

BACKGROUND OF THE INVENTION

It is well know that pressure operated switch constructions have been provided wherein each has a base carrying a pressure operated diaphragm. Such switches typically include an electrical switch unit controlled by the diaphragm and an adjustable compression spring that, in turn, is controlled by a cam operated actuator leaf pivotally carried by the base. Such pressure switches are often used to control the water level in consumer and commercial appliances, for example, clothes washing machines.

General operation of a pressure switch construction for controlling the liquid level in a washing machine is well known in the art. Briefly, a user selects a desired water level by rotating an external knob which is connected to a cam. This cam may have a continuously varying cam surface or discrete lobes thereon that define discrete water levels. The cam at the user selected position preloads the calibration spring of the pressure switch. As the water within the washing machine rises, the pressure from the height of the water lifts the diaphragm in the pressure switch until the force of the spring equals the height of the water. Once this occurs, the electrical switch within the pressure switch typically actuates to begin the next cycle, for example, the drain cycle. Such constructions and operations are well known as set forth in, for example, U.S. Pat. No. 4,081,637 to Stearley et al., U.S. Pat. No. 3,249,712 to Rhodes et al., and U.S. Pat. No. 5,336,858 to Kaigler, the teachings and disclosure of which are hereby incorporated in their entireties by reference thereto.

While the construction and operation of such pressure switches allow for the reliable automatic control of water levels during the various cycles of the programmed operation of the washing machine, embodiments of the present invention are directed to improvements on such pressure switches that allow for energy saving operation.

These and other advantages of the invention, as well as additional inventive features, will be apparent from the description of the invention provided herein.

BRIEF SUMMARY OF THE INVENTION

Embodiments of the present invention provide a new and improved pressure switch. More particularly, embodiments of the present invention provide a new and improved pressure switch that may be used, for example, to control the water level in a consumer or commercial appliance such as a washing machine. Still more particularly, embodiments of the present invention provide a new and improved pressure switch that allows for automated control of the water level within a consumer or commercial appliance while providing energy savings over conventional pressure switches.

In one embodiment, the pressure switch of the present invention provides a means to allow the user to select a desired water level for operation of the appliance. This user accessible means, for example a knob, is connected through a shaft to a cam that preloads a compression spring that will vary the level of switch actuation based upon the pressure resulting from the height of the water. In one embodiment of the present invention, the cam provides multiple water level settings. In a preferred embodiment of the present invention the cam provides four normal operational settings and one energy savings setting. Once the user has selected the desired water level, operation of the switch is governed by the preload force on the calibration spring and the pressure from the height of the water acting on the diaphragm within the pressure switch. When the pressure from the height of the water lifts the diaphragm until the force of the spring equals the height of the water, the electrical switch actuates to begin the next cycle in the programmed operation, for example the drain cycle.

In one embodiment of the present invention, the cam provides four normal and one energy savings setting. The energy saving setting utilizes a hook feature on the cam to grab the arm on the reset spring support. As the water level within the washing machine rises, pressure lifts the diaphragm and diaphragm support into the reset spring support. The reset spring support will then likewise rise until it is clear of the hook feature on the cam. A cam follower will then force the cam to rotate back to a relaxed position one level down. Subsequent fill operations will then be governed by the calibration spring loading based upon this new level of the cam.

As a result of this operation, energy savings are realized because the maximum amount of water is used only once before dropping down to the next highest level. In other words, in this embodiment of the present invention the user selection of the energy savings setting will allow the fill level of the washing machine to reach a maximum value during the initial fill operation, but subsequent fill operations will be governed by the next lower water level setting. If the user still desires to utilize the highest water level setting, the user may simply dial back into the highest setting. Similarly, the user may rotate the knob out of the highest, energy saving setting if so desired.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following will describe various embodiments of a one time high fill pressure switch that may be used in various applications including, but not limited to, commercial and consumer appliances such as washing machines to control the level of water used during the various stages of each programmed cycle. However, those skilled in the art will recognize that such description is provided by way of example only, and not by way of limitation. Indeed, other embodiments and operating environments will become apparent to those skilled in the art from the following description. Further, the general construction and operation of pressure switches will be described in cursory fashion in view of the well known operation as demonstrated, for example, by the above-identified patents which have been incorporated herein by reference.

Figure 1:
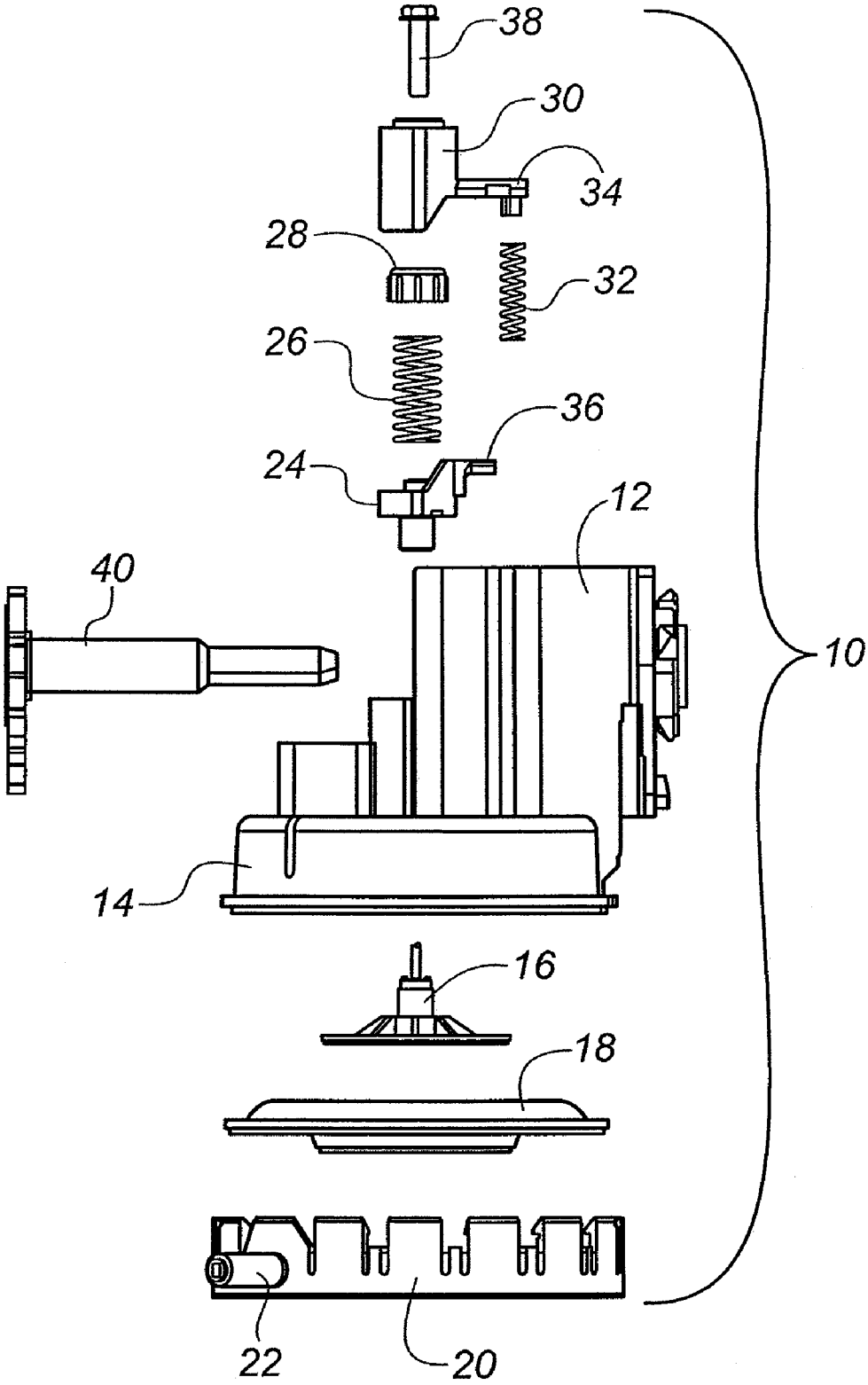
FIG. 1 is an exploded illustration of a one time high fill pressure switch constructed in accordance with the teachings of the present invention.

Turning now to the drawings, and in particular FIG. 1, there is illustrated an exploded view of one embodiment of a one time high fill pressure switch 10. In this embodiment, the one time high fill pressure switch utilizes a switch body 12 that includes a lower diaphragm chamber 14 into which a diaphragm support 16 and a diaphragm 18 are housed. Cap 20 encloses the diaphragm 18 within the chamber 14, and includes a pressure communication nipple 22 to communicate pressure from the water that flows into, for example, the washing tub.

In this embodiment the body 12 also carries a reset spring support 24. The calibration spring 26 is supported on a lower end by the reset spring support 24 and on an upper end by spring cap 28. The spring cap 28 and calibration spring 26 are accommodated in the cam follower 30. A follower spring 32 is positioned between the cam follower arm 34 of the cam follower 30 and latch arm 36 of the reset spring support 24. A calibration screw 38 is provided in one embodiment to allow calibration of the operation of the one time high fill pressure switch at each of the respective user selectable water levels as set by cam 40.

Figure 2:
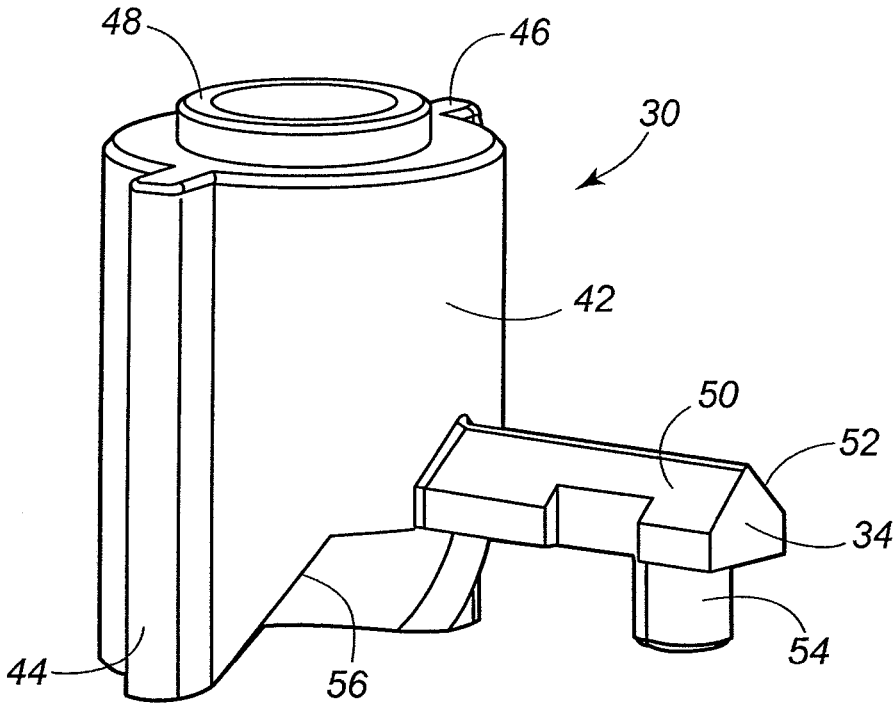
FIG. 2 is an isometric illustration of a cam follower used in the construction of the embodiment of the one time high fill pressure switch illustrated in FIG. 1.

The cam follower 30, as illustrated in FIG. 2, includes a central body portion 42 into which the spring cap and calibration spring are accommodated. The central body portion 42 also defines a pair of linear slides 44, 46 which, in coordination with body 12 ensures a linear translation of the cam follower 30 upon operation of the diaphragm 18 and diaphragm support 16 (see FIG. 1). The central body portion 42 also defines an upper annular ridge 48 that provides a land for calibration screw 38.

The cam follower 30 also includes cam follower arm 34 having angled cam follower surfaces 50, 52 which, as will be described more fully hereinbelow, cooperate with the cam 40 to define the various operating levels and modes of operation of the one time high fill pressure switch. Cam follower arm 34 also includes a lower depending follower spring support structure 54 around which follower spring 32 is positioned. Body 42 also includes a profiled lower surface opening 56 which cooperates with complimentary structure on the reset spring support illustrated in FIG. 3.

Figure 3:
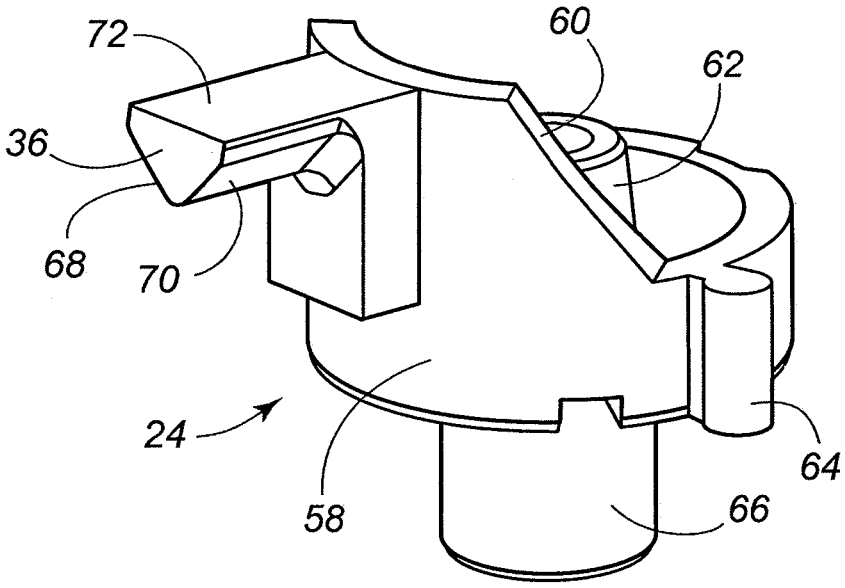
FIG. 3 is an isometric illustration of a reset spring support used in the construction of the embodiment of the one time high fill pressure switch illustrated in FIG. 1.

Turning to FIG. 3, the reset spring support 24 is illustrated in greater detail. This reset spring support 24 includes a main body portion 58 having a profiled upper surface 60 that cooperates with the profiled lower surface 56 of the cam follower 30 described above. The reset spring support also includes a calibration spring support structure 62 around which the calibration spring 26 is accommodated when the assembly of the one time high fill pressure switch is completed. The reset spring support 24 also includes a pair of linear support structures 64 on either side of the body portion 58. As with structures 44, 46 of the cam follower 30 illustrated in FIG. 2, the pair of linear support structures 64 cooperate with grooves in body 12 to ensure linear translation of the reset spring support 24 upon operation of the diaphragm 18 and diaphragm support 16. Indeed, the diaphragm support 16 (see FIG. 1) cooperates with the lower depending diaphragm support interface structure 66 to impart the linear translation thereon.

The reset spring support also includes latch arm 36 which defines a pair of angled surfaces 68, 70 that cooperate with a latching feature of cam 40 to be described more fully hereinbelow. This latch arm 36 also includes a flat upper surface 72 on which the follower spring 32 acts during operation of the one time high fill pressure switch as will be described more fully hereinbelow.

Figure 4:
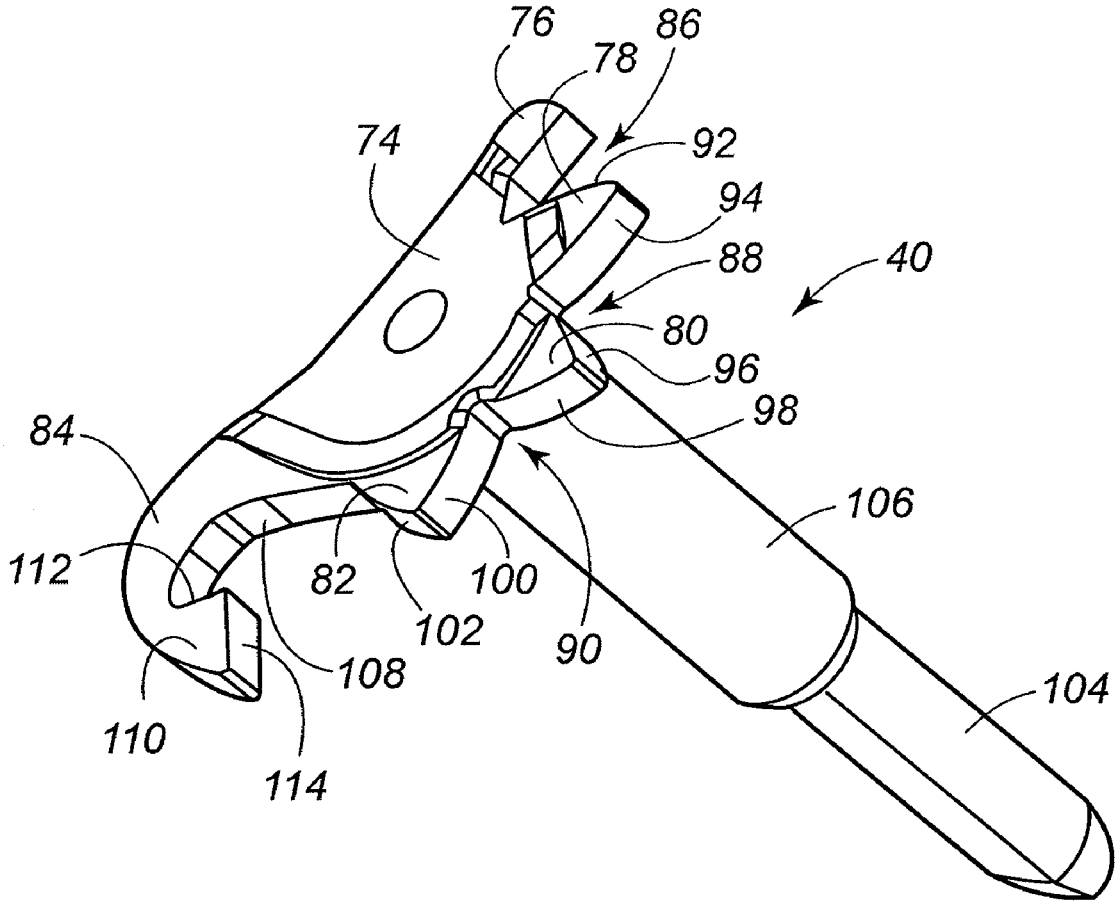
FIG. 4 is an isometric illustration of a cam utilized in the construction of the embodiment of the one time high fill pressure switch illustrated in FIG. 1.

Turning now to FIG. 4, the cam 40 of the embodiment of the one time high fill pressure switch of FIG. 1 is illustrated in greater detail. As may be seen, the cam program portion 74 includes a plurality of cam lobes 76, 78, 80, and 82 defining a number of different water level selection positions 86, 88, and 90 therebetween. Each of cam lobes 78, 80 and 82 include a pair of angled surfaces 92, 94, 96, 98, and 100, 102. These angled surfaces 92, 94, 96, 98, and 100, 102 cooperate with the angled surfaces 50, 52 of the cam follower arm 34 illustrated in FIG. 2 to allow user setting of the various water levels available with this embodiment of the one time high fill pressure switch. Such selection is accommodated by user rotation of a knob (not shown) that is accommodated on knob interface portion 104 of cam shaft 106 in a conventional manner.

The cam program disk 74 also includes a hook arm structure 84 having an inner profiled cam surface 108 that cooperates with the angled cam surfaces 50, 52 of the cam follower arm 34 in one mode of operation as will be discussed more fully hereinbelow. This hook arm structure 84 also includes a hook lobe 110 on an end thereof. This hook lobe 110 includes a pair of angled cam surfaces 112, 114 that cooperate with the angled surfaces 68, 70 of the latch arm 36 of reset spring support 24 (see FIG. 3) as will also be discussed more fully hereinbelow.

Figure 6:
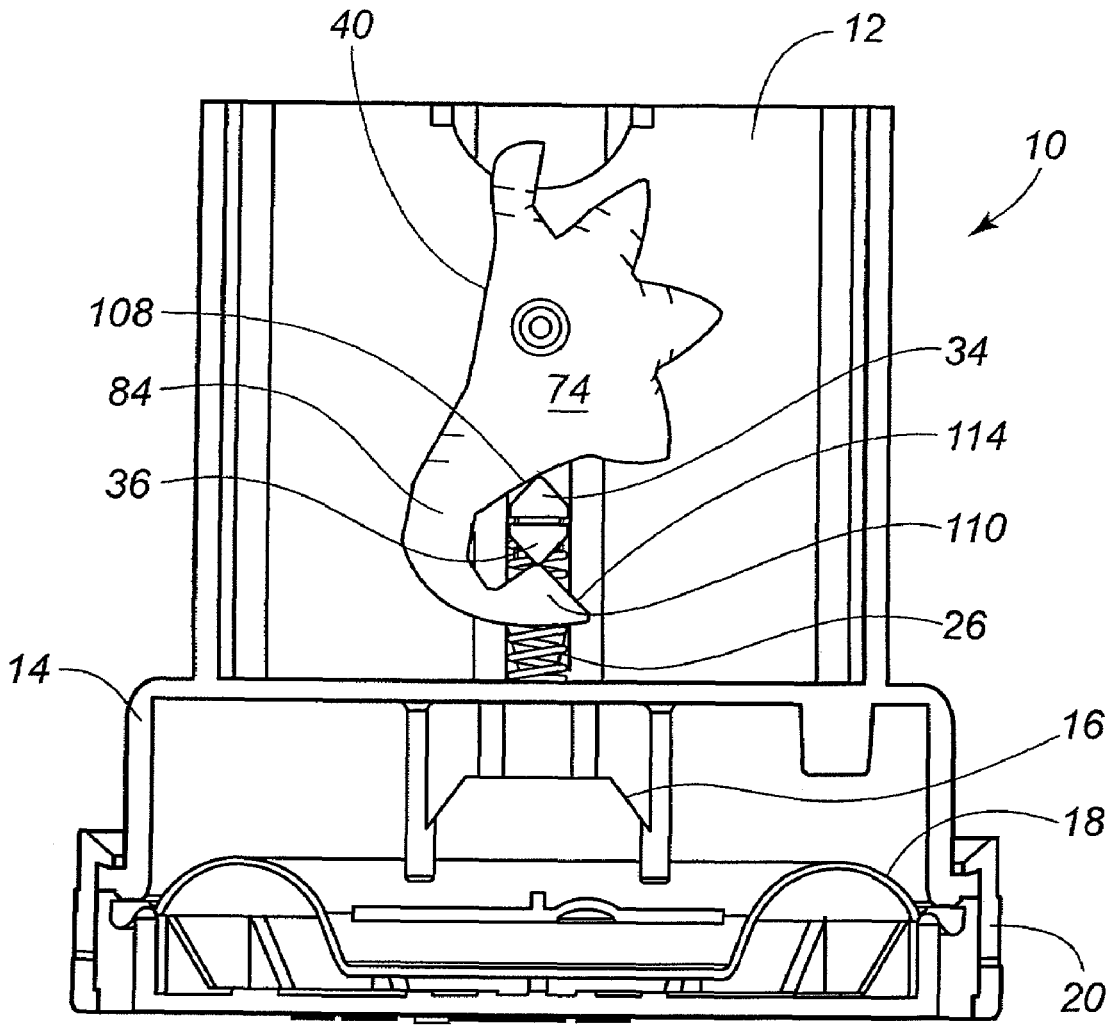
FIG. 6 is a side view illustration of the embodiment of the one time high fill pressure switch of FIG. 1 showing operation thereof as the water level within the appliance rises.
Figure 7:
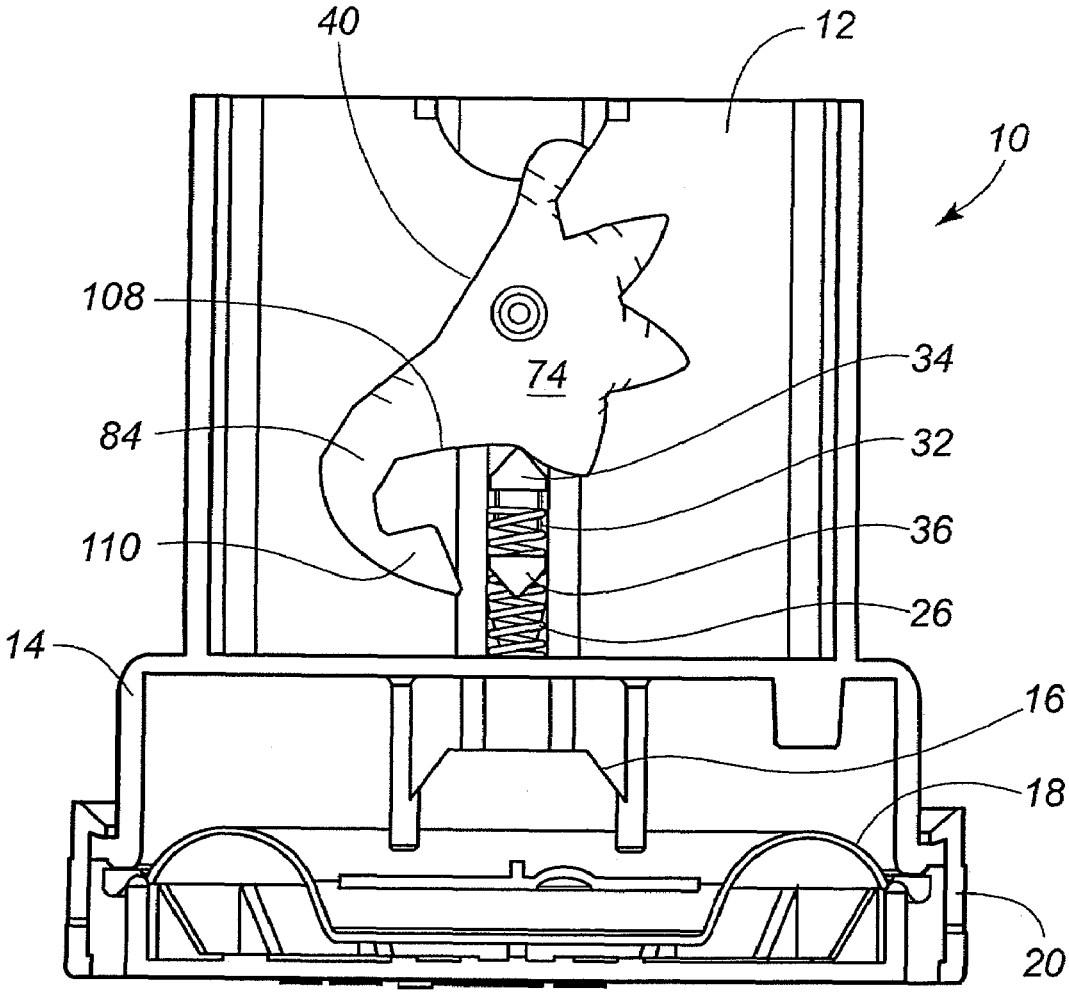
FIG. 7 is a side view illustration of the embodiment of the one time high fill pressure switch of FIG. 1 after the one time high fill has occurred.

Unique energy saving operation of the embodiment of the one time high fill pressure switch illustrated in FIG. 1 will be described in the following paragraphs with reference to FIGS. 5-7. Normal operation utilizing water settings below the high fill energy savings setting will not be described in detail herein as the functionality and operation of the pressure switch is not changed from a conventional pressure switch in these lower water level settings. Instead, reference is made to the above-identified patents, which are incorporated herein by reference, for the conventional operation in these lower water level setting positions.

Figure 5:
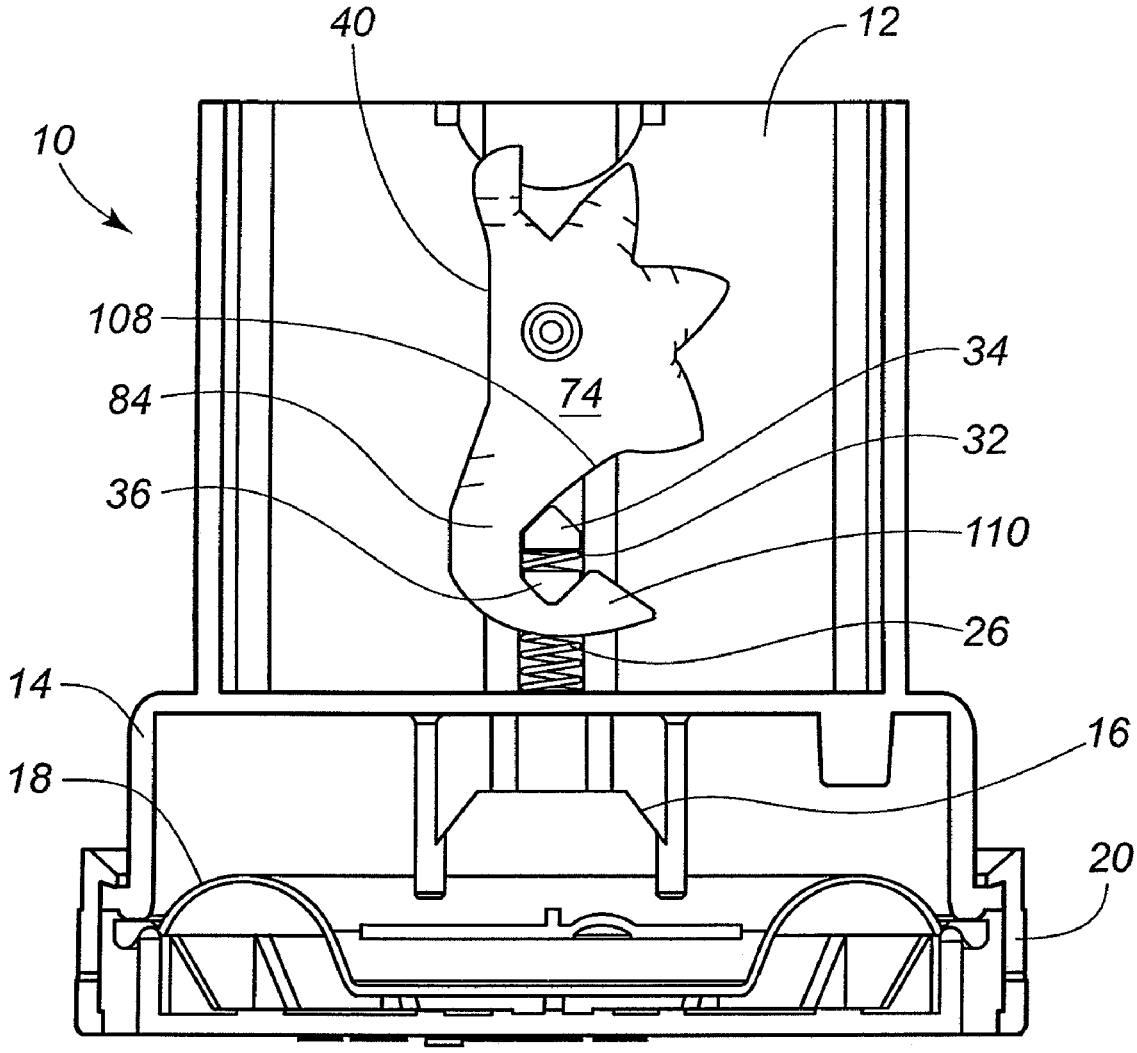
FIG. 5 is a side view illustration of the embodiment of the one time high fill pressure switch illustrated in FIG. 1 in a position resulting from user selection of the energy savings setting.

Turning specifically now to FIG. 5, there is illustrated one embodiment of the one time high fill pressure switch with the user positioned cam 40 positioned in the high fill energy savings mode. Once the user has rotated the cam 40 into this position, the hook lobe 110 captures the latch arm 36 of the reset spring support 24. The profiled cam surface 108 also positions the cam follower arm 34 to preload the calibration spring 26 to control the level of water that will be allowed to fill the laundry tub before actuation of the pressure switch. In the illustrated embodiment, this level is the maximum fill level of the washing tub.

As the level of water in the tub rises, pressure will expand the diaphragm 18 and lift the diaphragm support 16 into the reset spring support 24. As the water level continues to rise, the increased pressure will cause the diaphragm 18 and diaphragm support 16 to move the reset spring support 24 and its associated latch arm 36 linearly in an upward direction as illustrated in FIG. 5. With continued filling of the laundry tub, the movement of the diaphragm 18, diaphragm support 16 and latch arm 36 will also lift the cam follower arm 36 which will, in cooperation with the profiled cam surface 108, cause the cam 40 to rotate to the position illustrated in FIG. 6.

Once the water level has reached the maximum fill, the electrical switch (not shown) will actuate to begin the next cycle of the washing operation, for example, a drain cycle. Since the latch arm 36 is now free of the hook lobe 110, the follower spring 32 will act on both the latch arm 36 and the cam follower arm 34 to separate the two. This force, along with the force of the calibration spring 26, will initially aid in the continued rotation of cam 40 through cooperation with the profiled cam surface 108 and 114.

Once the latch arm 36 has cleared the hook lobe 110, operation of the calibration spring 26 will continue to rotate the cam 40 into its relaxed or quiescent position. This relaxed position is at the water level setting one level down from the maximum level setting initially selected by the user as illustrated in FIG. 7. The energy savings are realized through this operation by controlling the appliance to allow a maximum fill of the laundry tub only one time during a washing cycle before dropping down to the next highest level for continued operation throughout the remainder of the washing cycle. As such, less hot water, and less water in general, is utilized after the initial maximum fill level has been used to accomplish majority of the cleaning of the clothes placed therein. This results in a significant energy saving over continued use of a maximum fill level in each subsequent filling operation during the wash cycle.

If, however, the user wishes to continue to utilize a maximum fill setting, the user simply dials the cam back into the highest setting as illustrated in FIG. 5 for subsequent fill cycles. Similarly, if the user selects the maximum fill energy savings position by mistake, the user is readily able to dial back the setting to a lower water setting without requiring operation at that initial setting level.

Figure 9:
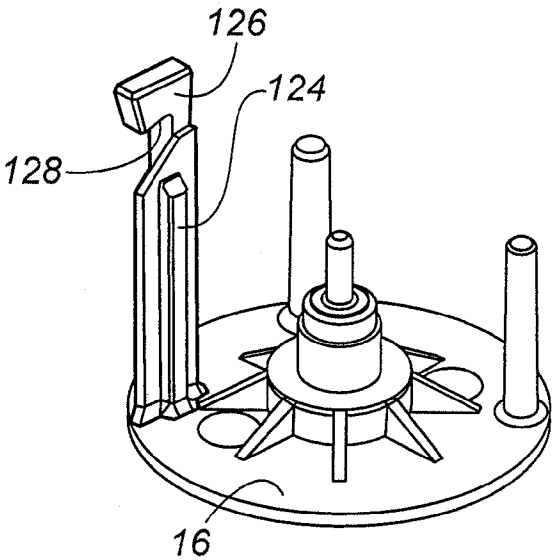
FIG. 9 illustrates the diaphragm support for the embodiment of the one time high fill pressure switch utilizing a diaphragm hook of FIG. 8.
Figure 10:
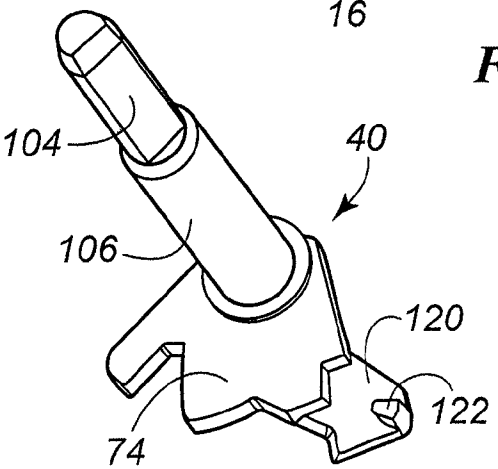
FIG. 10 illustrates the cam for the embodiment of the one time high fill pressure switch utilizing a diaphragm hook of FIG. 8.
Figure 8:
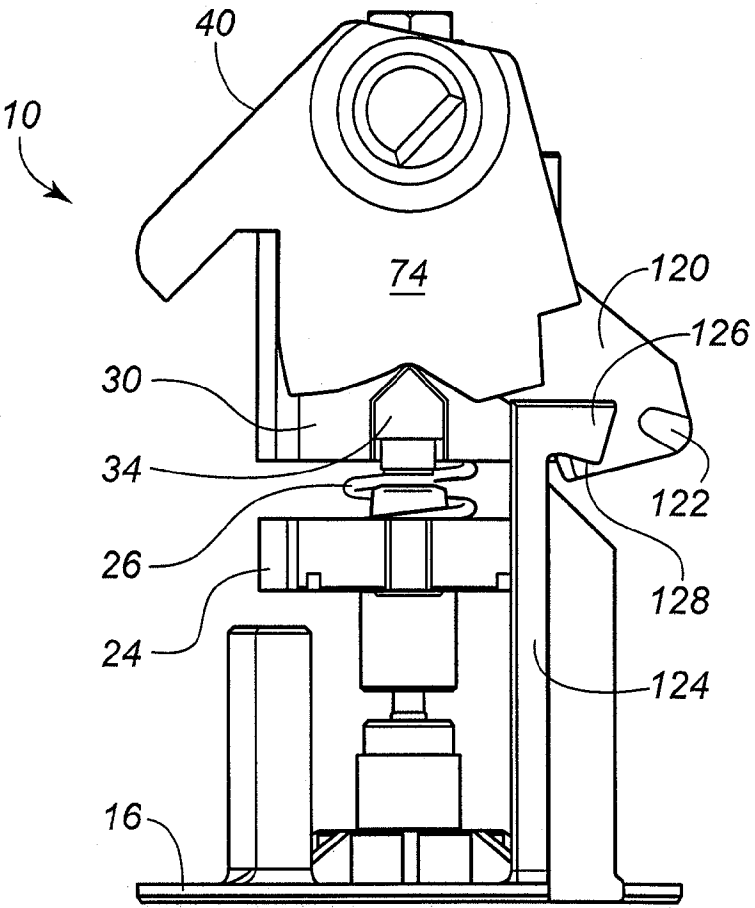
FIG. 8 illustrates an alternate embodiment of a one time high fill pressure switch utilizing a diaphragm hook.

FIG. 8 illustrates an alternate embodiment of the one time high fill pressure switch. The illustration of FIG. 8 does not illustrate the body 12, cap 20 or diaphragm 18 to simplify the understanding thereof. As illustrated, the cam 40 includes a cam capture surface 120 having a protrusion 122. This protrusion 122 is captured by the hook structure 126 of the diaphragm hook 124 when rotated by the user into the high fill energy savings setting. Details of the diaphragm support 16 may be better seen from the illustration of FIG. 9, and details of the cam 40 may be better seen from the illustration of FIG. 10.

During operation with the embodiment of the present invention illustrated in FIG. 8, increasing water level will cause the diaphragm to expand and linearly displace the diaphragm support 16 upwardly as illustrated in FIG. 8. This upward movement will first disengage structure 122 from the diaphragm hook structure 126 by sliding angled surface 128 of the diaphragm hook 124 causes cam 40 to rotate counterclockwise. As with the previous embodiment, once the hook 126 has been disengaged, the cam follower 34 will cause continued rotation of cam 40 until it rests in the next lower fill setting. Subsequent fill operations, therefore, will only be allowed to fill to this lower level setting thereby saving significant energy and cost over prior pressure switches.

Figure 12:
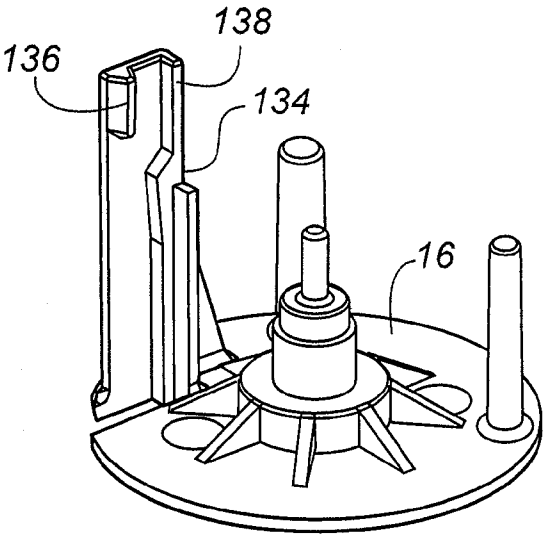
FIG. 12 illustrates the diaphragm support for the embodiment of the one time high fill pressure switch utilizing a diaphragm channel of FIG. 12.
Figure 13:
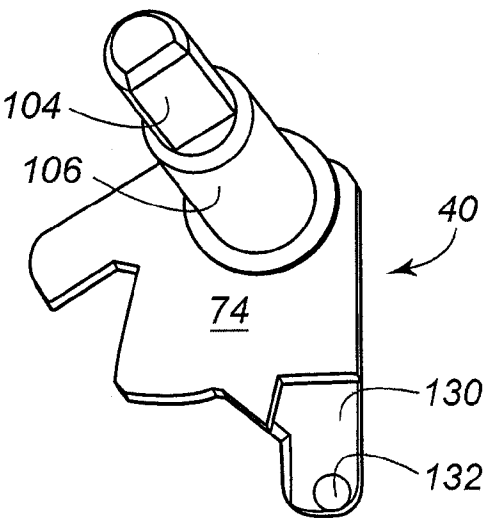
FIG. 13 illustrates the cam for the embodiment of the one time high fill pressure switch utilizing a diaphragm channel of FIG. 12.
Figure 11:
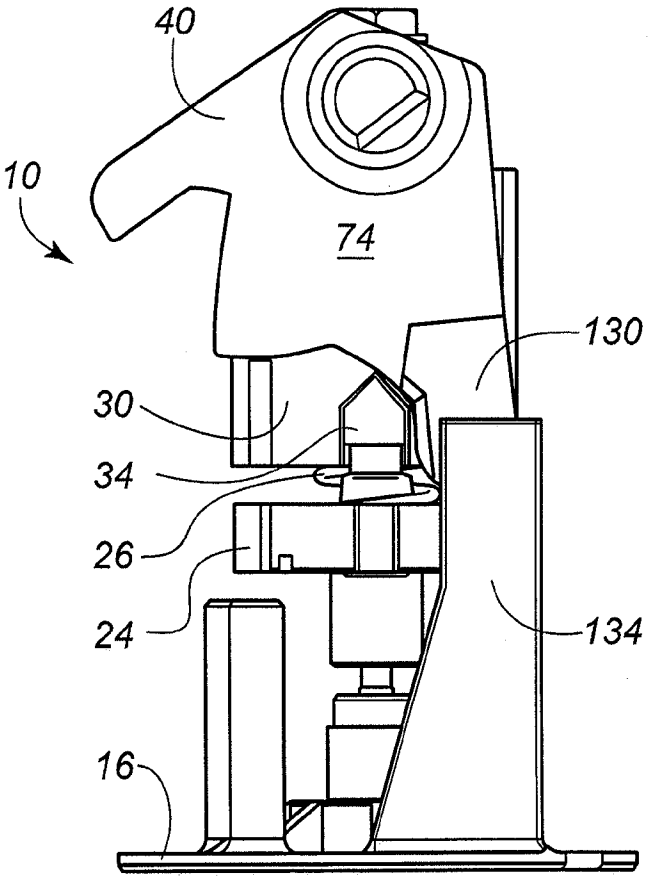
FIG. 11 illustrates an alternate embodiment of a one time high fill pressure switch utilizing a diaphragm channel.

A further embodiment of the one time high fill pressure switch of the present invention is illustrated in FIG. 11. In this embodiment, a diaphragm channel structure 134 is utilized to initially latch the cam 40 in the high fill energy savings position, and then to rotate the cam 40 to the next lower setting once the one time high fill has been accomplished. In this embodiment, the cam 40 includes a surface 130 which may best be seen in the illustration of FIG. 13. This surface 130 includes a latching structure 132 that is accommodated between walls 136 and 138 of the diaphragm support 16 as may best been seen from the illustration of FIG. 12.

As the one time high fill is being accomplished, expansion of the diaphragm 18 will linearly translate the diaphragm support 16 upward, causing the latching structure 132 to travel down the channel between walls 136 and 138. This will release the latching structure 132 and, through operation of the cam follower 34 described above, will result in the cam 40 rotating to position the cam follower 34 into the next lower water level setting. As such, subsequent fill operations governed by the pressure switch 10 will only be allowed to fill to the next lower level resulting in a significant savings over the life of the appliance.

Figure 15:
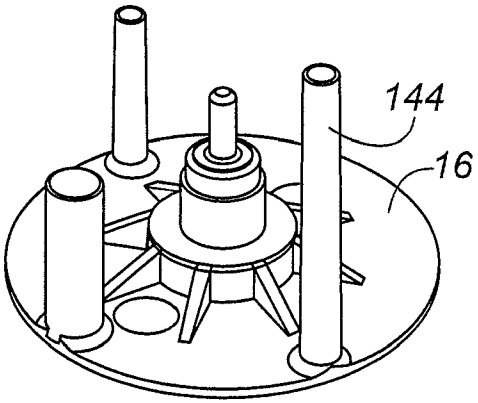
FIG. 15 illustrates the diaphragm support for the embodiment of the one time high fill pressure switch utilizing a cam catch of FIG. 14.
Figure 16:
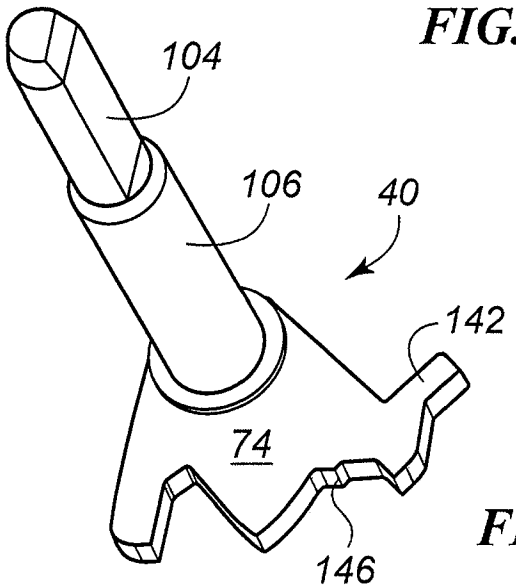
FIG. 16 illustrates the cam for the embodiment of the one time high fill pressure switch utilizing a cam catch of FIG. 14.
Figure 14:
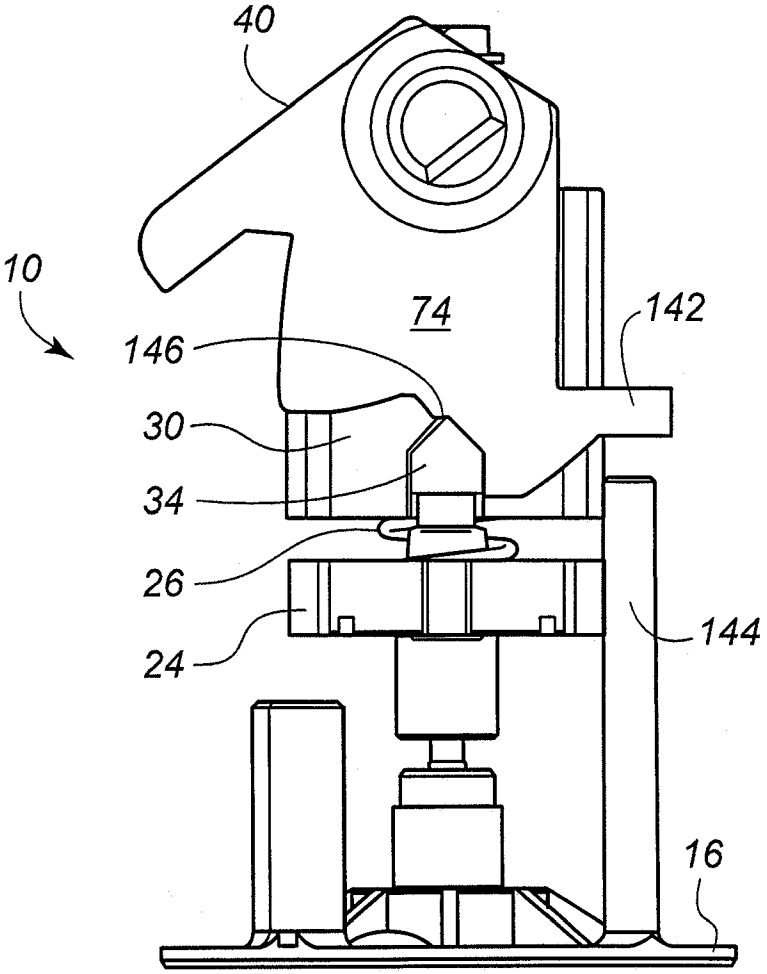
FIG. 14 illustrates an alternate embodiment of a one time high fill pressure switch utilizing a cam catch.

FIG. 14 illustrates a further embodiment of the one time high fill pressure switch of the present invention. In this embodiment, the diaphragm support 16 includes a cam catch 144. The cam catch 144 operatively contacts shoulder 142 of cam 40 to displace the cam follower 34 from its latched position held in notch 146 formed on cam surface 74. The structure of the diaphragm support 16 illustrating the cam catch 144 may best be seen from the illustration of FIG. 15, while the structure of cam 40 including the shoulder 142 and notch 146 may best be seen from the illustration of FIG. 16.

During operation of this embodiment, the user rotates the cam 40 to its maximum fill energy savings position, at which point the cam follower is latched in place with notch 146. As the water level rises within the laundry tub, the diaphragm 18 expands to linearly translate diaphragm support 16 upwardly in the illustration of FIG. 14. As the water continues to rise and the pressure continues to build, the cam catch 144 will contact shoulder 142 of cam 40 causing it to rotate counterclockwise in the illustration of FIG. 14. The rotation of cam 40 caused by the rising cam catch 144 acting on shoulder 142 will displace the cam follower 34 from its latched position in notch 146. Continued rotation of cam 40 will result in cam follower 34 being positioned in the next lower water level setting once this one time high fill has been accomplished. As a result, subsequent fill operations of the appliance will only be allowed to continue until the lower water level setting is reached, resulting in significant energy and cost savings.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A one time high fill pressure switch, comprising:

a body;

a diaphragm housed within the body;

a diaphragm support in operative communication with the diaphragm within the body, the diaphragm support being linearly translated upon expansion and contraction of the diaphragm;

a compression spring in operative communication with the diaphragm support;

a cam follower in operative communication with the compression spring;

a cam in operative communication with the cam follower, the cam having a plurality of user selectable positions positioning the cam follower to provide a plurality of preloads on the compression spring; and means for holding the cam follower in a high fill position for one fill operation, the means for holding thereafter allowing the cam follower to move to a next lower fill position of the cam.

2. The one time high fill pressure switch of claim 1, wherein the means for holding comprises:

a hook arm structure operatively coupled to the cam;

a reset spring support operatively positioned between the diaphragm support and the compression spring, the reset spring support including a latch arm configured to be held by the hook arm structure in the high fill position of the cam and to be released by the hook arm structure when linearly translated by the diaphragm support upon expansion of the diaphragm.

3. The one time high fill pressure switch of claim 2, wherein the hook arm structure includes a hook lobe at one end thereof having a first pair of angled surfaces, and wherein the latch arm includes a second pair of angled surfaces that act with the first pair angled surfaces of the hook lobe to aid in the positioning the latch arm within and without of the high fill position.

4. The one time high fill pressure switch of claim 2, wherein the hook arm structure includes a profiled cam surface that cooperates with the cam follower to rotate the cam to position the cam follower to the next lower fill position.

5. The one time high fill pressure switch of claim 2, further comprising a follower spring positioned between the cam follower and the reset spring support, the follower spring providing a biasing force to aid retention of the latch arm in the hook arm structure and to aid in rotating the cam to the next lower fill position of the cam after the one fill operation.

6. The one time high fill pressure switch of claim 1, wherein the means for holding comprises:

a diaphragm hook operatively coupled to the diaphragm support; and a cam capture surface operatively coupled to the cam, the cam capture surface including a protrusion configured to be held by the diaphragm hook in the high fill position of the cam.

7. The one time high fill pressure switch of claim 6, wherein the diaphragm hook includes an angled surface along which the protrusion slides until it is disengaged from the hook structure by action of the compression spring on the cam follower such that the cam is rotated.

8. The one time high fill pressure switch of claim 1, wherein the means for holding comprises:

a diaphragm channel structure operatively coupled to the diaphragm support; and a cam surface operatively coupled to the cam, the cam surface including a capture structure configured to be held by a channel of the diaphragm channel structure in the high fill position of the cam.

9. The one time high fill pressure switch of claim 8, wherein linear translation of the diaphragm channel structure moves the capture structure along the channel until an end of the channel is reached, at which point the capture structure is free to rotate out of the channel by action of the compression spring on the cam follower such that the cam is rotated.

10. The one time high fill pressure switch of claim 1, wherein the means for holding comprises:

a cam catch operatively coupled to the diaphragm support; and a shoulder operatively coupled to the cam, the cam surface including a notch configured to hold the cam follower in the high fill position of the cam.

11. The one time high fill pressure switch of claim 10, wherein linear displacement of the diaphragm support causes the cam catch to contact the shoulder, rotate cam, and displace the cam follower from the notch.

12. A one time high fill pressure switch, comprising:

a body;

a diaphragm housed within a cavity of the body;

a diaphragm support in operative communication with the diaphragm within the body, the diaphragm support being linearly translated upon expansion of the diaphragm;

a compression spring in operative communication with the diaphragm support;

a cam follower in operative communication with the compression spring;

a cam in operative communication with the cam follower, the cam having a plurality of user selectable positions positioning the cam follower to provide a plurality of preloads on the compression spring, the cam further including a hook arm structure; and a reset spring support operatively positioned between the diaphragm support and the compression spring, the reset spring support including a latch arm configured to be held by the hook arm structure in the high fill position of the cam and to be released by the hook arm structure when linearly translated by the diaphragm support upon expansion of the diaphragm.

13. The one time high fill pressure switch of claim 12, wherein the hook arm structure includes a hook lobe at one end thereof having a first pair of angled surfaces, and wherein the latch arm includes a second pair of angled surfaces that act with the first pair angled surfaces of the hook lobe to aid in the positioning the latch arm within and without of the high fill position.

14. The one time high fill pressure switch of claim 12, wherein the hook arm structure includes a profiled cam surface that cooperates with the cam follower to rotate the cam to position the cam follower to the next lower fill position after the latch arm has been linearly translated by the diaphragm support to be released from the hook arm structure.

15. The one time high fill pressure switch of claim 12, further comprising a follower spring positioned between the cam follower and the reset spring support, the follower spring providing a biasing force to aid retention of the latch arm in the hook arm structure and to aid in rotating the cam to the next lower fill position of the cam after the one fill operation.

16. The one time high fill pressure switch of claim 15, wherein the cam follower includes a cam follower arm having a lower depending follower spring support structure around which the follower spring is positioned, and wherein the reset spring support includes a latch arm, the follower spring being positioned between the cam follower arm and the latch arm.

17. The one time high fill pressure switch of claim 12, wherein the cam includes a plurality of lobes defining different fill positions therebetween, and wherein the hook arm structure and an adjacent lobe define a next lower fill position therebetween.

18. The one time high fill pressure switch of claim 17, wherein the cam includes four lobes and the hook arm structure resulting in five fill positions.

19. A washing machine, comprising:

a washing tub;

a one time high fill pressure switch operatively coupled to control a level of water in the washing tub, the one time high fill pressure switch including a diaphragm, a diaphragm support in operative communication with the diaphragm, the diaphragm support being linearly translated upon expansion of the diaphragm, a compression spring in operative communication with the diaphragm support, a cam follower in operative communication with the compression spring, a cam in operative communication with the cam follower, the cam having a plurality of user selectable positions positioning the cam follower to provide a plurality of preloads on the compression spring, the cam further including a hook arm structure, and a reset spring support operatively positioned between the diaphragm support and the compression spring, the reset spring support including a latch arm configured to be held by the hook arm structure in the high fill position of the cam and to be released by the hook arm structure when linearly translated by the diaphragm support upon expansion of the diaphragm; and wherein the hook arm structure includes a profiled cam surface that cooperates with the cam follower to rotate the cam to position the cam follower to the next lower fill position once one high fill has been completed and the latch arm has been released from the hook arm structure by the linear translation of the diaphragm support upon expansion of the diaphragm.

* * * * *